US009144529B2

(12) United States Patent
Culver

(10) Patent No.: US 9,144,529 B2
(45) Date of Patent: Sep. 29, 2015

(54) RANGE OF MOTION ASSISTANT

(76) Inventor: Stephen Lynn Culver, Midland, TX (US)

( * ) Notice: Subject to any disclaimer, the term of this patent is extended or adjusted under 35 U.S.C. 154(b) by 750 days.

(21) Appl. No.: 13/192,351

(22) Filed: Jul. 27, 2011

(65) Prior Publication Data

US 2011/0301509 A1 Dec. 8, 2011

(51) Int. Cl.
*A61H 1/02* (2006.01)

(52) U.S. Cl.
CPC ..... *A61H 1/0285* (2013.01); *A61H 2001/0207* (2013.01); *A61H 2201/1269* (2013.01)

(58) Field of Classification Search
CPC ... A61F 5/0111; A61F 5/0113; A61F 5/0118; A61F 5/0127; A61F 5/013; A61F 2005/0134; A61F 2005/0137; A61F 2005/0141; A61F 2005/0146; A61F 2005/0148; A61F 2005/0151; A61F 2005/0153; A61F 2005/0195; A61H 1/001; A61H 1/0266; A61H 1/0285; A61H 1/0288; A61H 2001/0203; A61H 2001/0207; A61H 2001/0266; A61H 2201/0153; A61H 2201/0157; A61H 2201/1635; A61H 2201/1638; A61H 2205/065; A61H 2205/067
USPC ..... 601/5, 23, 27, 33, 34, 40
See application file for complete search history.

(56) References Cited

U.S. PATENT DOCUMENTS

| | | | | |
|---|---|---|---|---|
| 4,267,649 | A * | 5/1981 | Smith | 36/101 |
| 4,719,906 | A * | 1/1988 | DeProspero | 602/21 |
| 5,203,321 | A * | 4/1993 | Donovan et al. | 601/5 |
| 5,472,410 | A | 12/1995 | Hamersly | |
| 5,503,619 | A * | 4/1996 | Bonutti | 602/16 |
| 5,520,625 | A | 5/1996 | Malewicz | |
| 5,611,764 | A | 3/1997 | Bonutti et al. | |
| 5,738,636 | A * | 4/1998 | Saringer et al. | 601/5 |
| 5,921,945 | A * | 7/1999 | Gray | 602/5 |
| 6,001,074 | A * | 12/1999 | Kenney | 602/7 |
| 6,179,799 | B1 | 1/2001 | Doran | |
| 6,386,418 | B1 * | 5/2002 | Garner | 227/133 |
| 6,443,874 | B1 | 9/2002 | Bennett | |
| 6,506,172 | B1 * | 1/2003 | Hepburn et al. | 601/5 |
| 6,723,061 | B2 | 4/2004 | Williams | |
| 6,740,051 | B2 | 5/2004 | Hepburn et al. | |
| 8,257,283 | B2 * | 9/2012 | Kaiser | 601/5 |
| 8,377,144 | B2 * | 2/2013 | Jonsson et al. | 623/38 |
| 8,485,994 | B1 * | 7/2013 | Erb | 601/5 |
| 2009/0030353 | A1 * | 1/2009 | Bonutti et al. | 601/5 |
| 2009/0124936 | A1 * | 5/2009 | Branch et al. | 600/587 |
| 2009/0151039 | A1 * | 6/2009 | Kielland | 2/24 |
| 2010/0179388 | A1 * | 7/2010 | Ovnicek et al. | 600/300 |
| 2010/0198115 | A1 * | 8/2010 | Koeneman et al. | 601/5 |
| 2011/0061265 | A1 * | 3/2011 | Lyden | 36/103 |
| 2013/0035771 | A1 * | 2/2013 | Pedersen et al. | 623/65 |
| 2013/0076626 | A1 * | 3/2013 | Banik | 345/163 |
| 2013/0131568 | A1 * | 5/2013 | Golden et al. | 602/20 |

* cited by examiner

*Primary Examiner* — Justine Yu
*Assistant Examiner* — LaToya M Louis

(57) ABSTRACT

A passive therapy device to facilitate range-of-motion in the human hand, wrist, or forearm after surgery, trauma, rehabilitative therapy, or other events that resulted in limited wrist motion or stiffness. This device facilitates wrist therapy by utilizing gravity and leverage. The therapy device includes two generally isosceles triangular rigid sides functioning as top and bottom, joined by and narrowing to a point via a sandwiched solid wedge, a hand strap and wrist strap of a strong, soft material on the outside of the top rigid side. This device provides therapy to restricted tissue in the human hand, wrist, or forearm while applying passive tension during rehabilitation. Readily converting from supination or pronation therapy to extension or flexion therapy, and radial or ulnar deviation, the device can be used on the right or left hand. This invention provides a low cost, effective and simple to use wrist rehabilitation device.

2 Claims, 3 Drawing Sheets

RANGE OF MOTION ASSISTANT

FIELD OF INVENTION

The invention finds applicability in the field of hand, wrist or forearm rehabilitation. It relates to an adjustable orthosis, which can be used for stretching human tissue such as ligaments, tendons or muscles involving a hand, wrist or forearm.

BACKGROUND

Where there is injury to the hand, wrist or forearm, often immobilization is required. After immobilization, the hand, wrist or forearm are stiff. In view of this fact, it would be desirable to bring flexibility back to the stiff joints as quickly as possible. This invention accomplishes this objective.

In recent years it has become evident that the rehabilitation and treatment of injured joints can be expedited by use of passive motion of the joint. Passive motion entails inducing movement of certain limb portions without requiring muscle coordination or control by a patient's injured hand or wrist. Studies have shown passive motion of joints accelerates healing and recovery time.

On Jan. 8, 2011, I fell 15 feet onto a hard surface. Among the numerous broken bones were multiple compound fractures in my left wrist. During the healing process my doctor suggested that I begin therapy. Initially the goal was supination and pronation, then later flexion, extension, radial and ulnar deviation. The method suggested to achieve this goal, was to hold a hammer with my injured hand, by the handle and allow the weight of the hammer to stretch the soft tissue. This did not work very well. The handle of the hammer was difficult to hold. I thought there must be a better way. The better way, which I personally invented, is the device for which I am seeking patent protection. During a USPTO search, I found numerous other inventions with similar claims to improve range of motion such as Hepburn et al U.S. Pat. No. 6,740,051, Doran U.S. Pat. No. 6,179,799, and Bennett U.S. Pat. No. 6,443,874 to name a few. Most inventions I found were complicated, cumbersome, or cost prohibitive. I believe my invention overcomes those obstacles as well as offering additional therapeutic features.

BRIEF SUMMARY OF INVENTION

This range of motion assistant invention has been named LeverWrist® due to the functions it performs. The LeverWrist® was designed to gently force movement, stretching the soft tissue, to recover all six major directions of wrist movement (extension, flexion, supination, pronation, radial and ulnar deviation). The LeverWrist® aids in rehabilitation and recovery from various injuries, surgeries and trauma to the wrist and surrounding area.

The objective of stretch therapy is to improve range of motion without compromising the stability and quality of the connective tissue and joint. The LeverWrist® accomplishes this objective with a simple and easy to use device.

The LeverWrist® essentially allows a patient to duplicate physical therapy in a home setting thereby accelerating the healing time required. The LeverWrist® can be moved by an uninjured hand of the patient or therapist thereby applying force to the stiff or injured wrist.

Often after surgery, trauma, arthritic complications, or other injuries causing limited wrist motion or stiffness, rehabilitative therapy is necessary. The LeverWrist® is a simple to use physical therapy tool that can easily be used in a clinical setting or at home while watching television.

The LeverWrist® uses gravity and leverage to aid in therapy to help restore movement.

DESCRIPTION

The LeverWrist® Range of Motion Assistant is a passive therapy device designed to facilitate range-of-motion in the human hand, wrist, or forearm. The invention is designed for use after surgery, trauma, arthritic complications, rehabilitative therapy, or other events that result in limited wrist motion or stiffness. This device assists in range of motion therapy by utilizing gravity and leverage. With the LeverWrist®, a patient or therapist can control comfort level and the amount of stretching by simply adjusting the hand position and amount of gentle sustained force applied. Unlike other range-of-motion therapy devices, there are no mechanical components to twist, tighten, hinge or set. Rehabilitation of restricted tissue is achieved by insertion of patient's hand and wrist (palm down) into wrist strap 1 and hand strap 2 or hand and wrist (palm up) into the open end 7 with movement of the device in an appropriate direction controlled by a patient or therapist, thus providing a simple, effective and more affordable therapy tool for regaining range-of-motion in the hand, wrist or forearm.

With reference to FIG. 1, the device incorporates rigid sides comprised of two generally isosceles triangles 4 top and 6 bottom, joined yet separated by and narrowing to a pivot end 5 by means of a sandwiched solid wedge 3. The device also utilizes a hand strap 2, and wrist strap 1 comprised of a strong yet soft material on the top generally isosceles triangle 4. This device provides therapy to restricted tissue in a hand, wrist, and forearm by applying passive tension during rehabilitation.

Supination (palm facing up) is achieved by placing an injured wrist or hand between the top 4 and bottom 6 rigid generally isosceles triangle sides, into the open-end of the device 7, palm up. A patient then gently rests the smaller pivot end 5 on their lap. As patient relaxes affected limb, gravity and leverage produce gentle torque resulting in muscle and soft tissue stretching. Amount of torque applied is a direct result of the amount of stiffness involved, along with the level of aggression used during therapy. Supination therapy is illustrated in FIG. 4.

Pronation of the hand occurs when the hand is turned so that the palmar or anterior side of the hand and wrist face downward and the opposite or posterior side of the hand and wrist face upward. Pronation (palm facing down) is achieved by placing the injured wrist or hand between the top 4 and bottom 6 rigid generally isosceles triangles, into the open-end of the device 7, palm facing the inside of the top 1 rigid generally isosceles triangles. The user then rotates the smaller pivot end 5 as illustrated by arrows in FIG. 5 to provide stretching of the soft tissue towards a goal of pronation.

The range of motion assistant device readily converts from supination and pronation therapy to extension and flexion therapy or radial and ulnar deviation therapy by moving the hand and wrist from the open end 7 to the soft hand strap 2 and wrist strap 1 on the top generally isosceles triangle 4. Further, the device can also be used on the right or left hand. To achieve soft tissue stretching for flexion and extension, the hand strap 2 and wrist strap 1 are utilized. Patient places the hand palm down, onto the top of the rigid generally isosceles triangle 4 and into the wrist strap 1 and hand strap 2 with thumb protruding between wrist strap 1 and hand strap 2. The smaller pivot end 5 is then gently and slowly lifted or lowered creating a slight torque on the wrist in the desired direction. Extension and flexion are illustrated in FIGS. 6 and 7 respectively.

To achieve soft tissue stretching for radial and ulnar deviation, wrist strap 1 and hand strap 2 are utilized. Patient places the hand palm down onto the top of the rigid generally isosceles triangle 4 and into the wrist strap 1 and hand strap 2 with thumb protruding between wrist strap 1 and hand strap 2. The smaller pivot end 5 is then gently and slowly moved directionally right or left creating a slight torque in the desired direction. Radial and ulnar deviation is illustrated in FIG. 8.

1. Wrist strap used for Flexion, Extension, Radial and Ulnar Deviation

2. Hand Strap used for Flexion, Extension, Radial and Ulnar Deviation

3. Separating solid wedge

4. Top rigid generally isosceles triangle

5. Pivot end

6. Bottom rigid generally isosceles triangle

7. Open end for patient's hand used for Supination and Pronation

Figure 1:
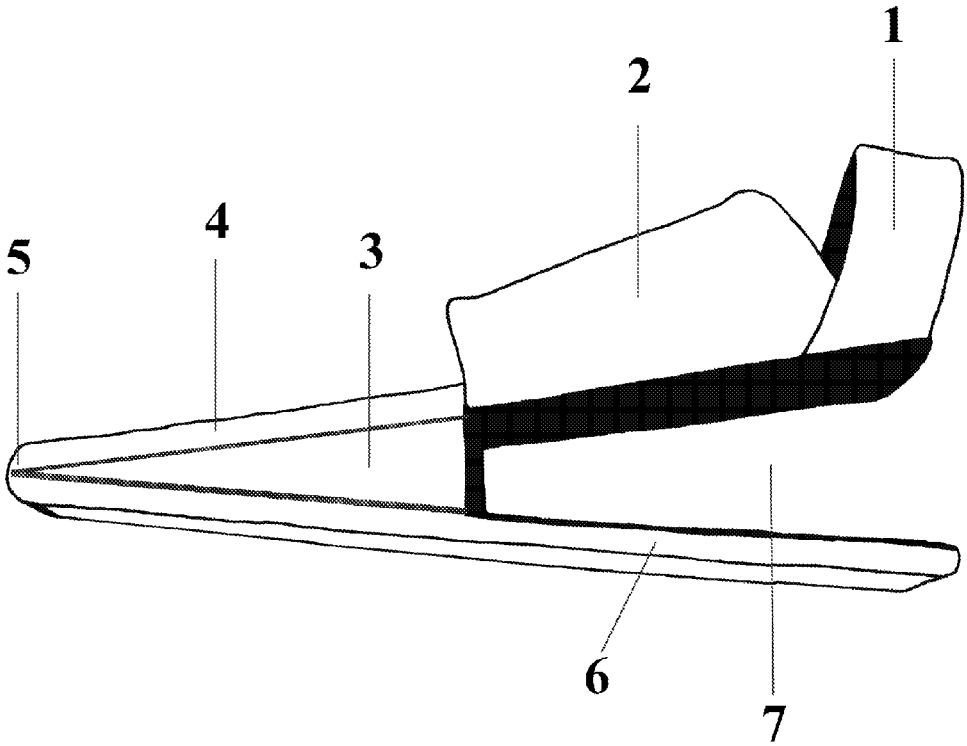
FIG. 1 Perspective view of the range of motion assistant device
Figure 2:
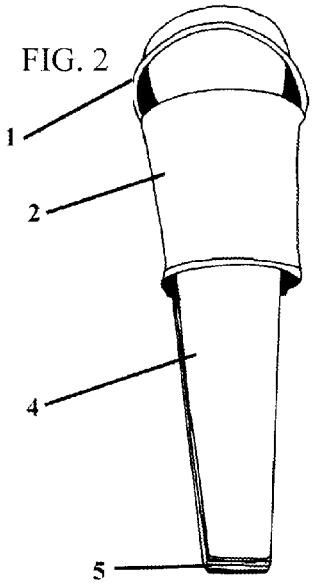

FIG. 2 Top view of the range of motion assistant device

Figure 3:
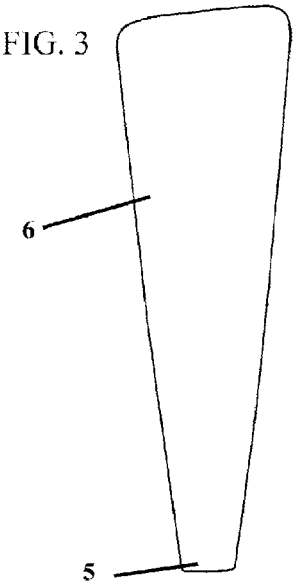

FIG. 3 Bottom view of the range of motion assistant device

Figure 4:
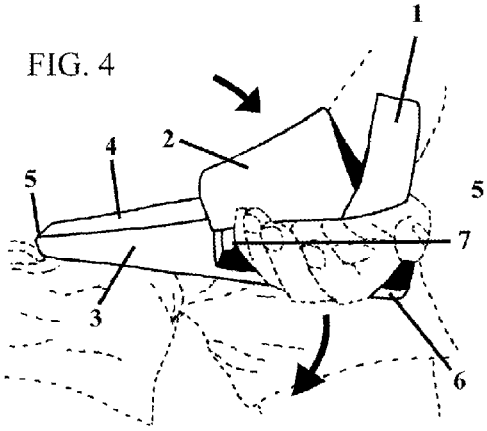
Figure 5:
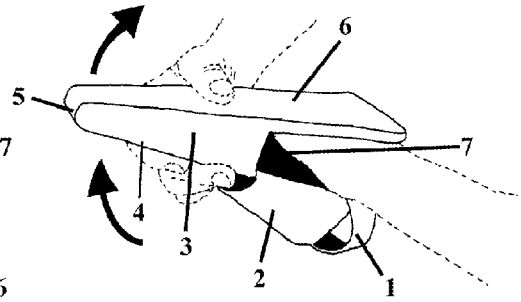
Figure 6:
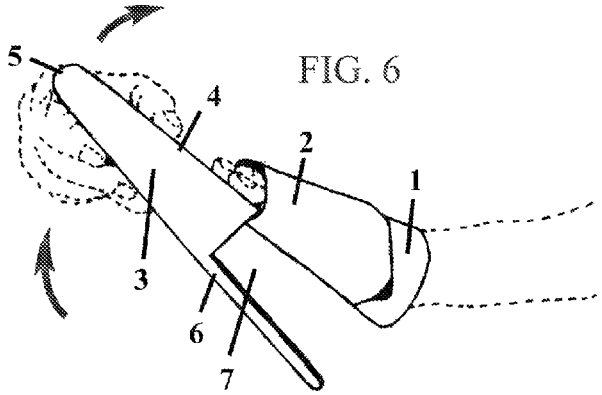
Figure 7:
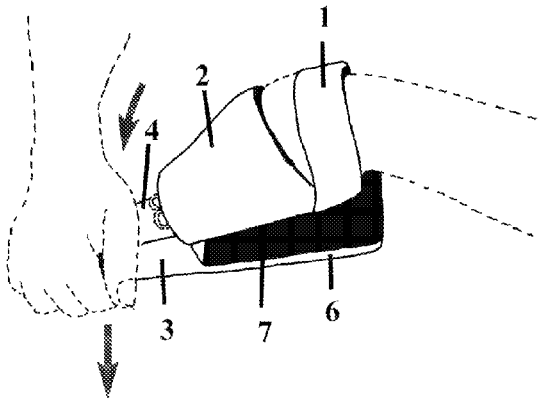
Figure 8:
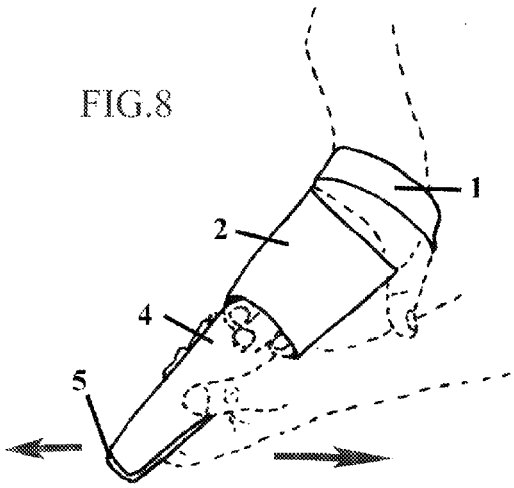

FIG. 4 Usage view; dotted lines represent use to improve supination, arrows represent movement FIG. 5 Usage view; dotted lines represent use to improve pronation, arrows represent movement FIG. 6 Usage view; dotted lines represent use to improve extension, arrows represent movement FIG. 7 Usage view; dotted lines represent use to improve flexion, arrows represent movement FIG. 8 Usage view; dotted lines represent use to improve radial and ulnar deviation, arrows represent movement

What is claimed is:

1. A therapy device consisting of:

a first rigid wall having an inner surface and an outer surface, the first rigid wall forming a top side;

a second rigid wall having an inner surface and an outer surface, the second rigid wall forming a bottom side, wherein each one of the first and second walls is shaped as a generally isosceles triangle and has a first end opposite a second end, wherein the first end of the first wall is joined to the first end of the second wall at a connection point to form a closed end of the therapy device and wherein the second end of the first wall is spaced apart from the second end of the second wall to form an opened end of the therapy device;

a solid wedge sandwiched between the first wall and the second wall at the closed end, wherein the sandwiched solid wedge contacts the inner surface of the first wall and the inner surface of the second wall, the solid wedge tapering in both width and height and having a narrow end in contact with the connection point; and two straps positioned on the outer surface of the first wall at the open end, the straps attached to the second end of the first wall opposite the connection point;

wherein the open end is configured to receive a patient's hand between the first and second walls with a palm of the patient's hand facing the inner surface of the first wall and wherein the therapy device is configured to provide supination and pronation therapy to the hand and a wrist of the patient when the closed end is moved to apply torque for stretching soft tissue thereby providing improved range of motion and mobility.

2. The therapy device of claim 1 wherein the straps on the outer surface of the first wall are configured to receive the patient's hand and wrist with palm of the hand facing the outer surface of the first wall, wherein the therapy device is configured to provide flexion, extension, radial, and ulnar deviation therapy to the hand and the wrist of the patient when the closed end is moved.

* * * * *